US006100457A

United States Patent [19]

Harris et al.

[11] Patent Number: 6,100,457

[45] Date of Patent: Aug. 8, 2000

[54] STRING ARRANGEMENT FOR MUSICAL INSTRUMENTS

[75] Inventors: Richard L. Harris; Michael J. Wathen, both of Cincinnati, Ohio

[73] Assignee: The University of Cincinnati, Cincinnati, Ohio

[21] Appl. No.: 09/091,343

[22] PCT Filed: Dec. 13, 1996

[86] PCT No.: PCT/US96/20089

§ 371 Date: Jun. 12, 1998

§ 102(e) Date: Jun. 12, 1998

[87] PCT Pub. No.: WO97/22113

PCT Pub. Date: Jun. 19, 1997

[51] Int. Cl.[7] ..... G10C 3/04

[52] U.S. Cl. ..... 84/211; 84/214

[58] Field of Search ..... 84/200, 202, 208, 84/211, 213, 214

[56] References Cited

U.S. PATENT DOCUMENTS

| | | |
|---|---|---|
| 154,116 | 8/1874 | Diehl . |
| 358,946 | 3/1887 | Sohmer . |
| 566,146 | 8/1896 | Dathan . |
| 954,189 | 4/1910 | Hutchinson . |
| 1,026,922 | 5/1912 | Nystrom . |
| 2,075,001 | 3/1937 | Schulze . |
| 2,191,487 | 2/1940 | Kuzelka . |
| 4,155,284 | 5/1979 | Graves . |
| 4,478,125 | 10/1984 | Rodriguez . |
| 4,602,548 | 7/1986 | Conklin, Jr. . |

OTHER PUBLICATIONS

The Physics of Musical Instruments, People and Pianos, A Centruy of Service to Music, Neville H. Fletcher and Thomas D. Rossing, Steinway & Sons (New York), © 1953, 1961, by Steinway & Sons, p. 36.

The Coupled Motions of Piano Strings, *Scientific American,* Gabriel Weinreich, Jan. 1979, pp. 118–123.

The Piano—Its Acoustics, W. V. McFerrin, (Boston)© 1972 Tuners Supply Company, pp. 86–87.

The Physics of Musical Instruments, Neville H. Fletcher and Thomas D. Rossing, Springer–Verlag, © 1991 Springer–Verlag (New York), pp. 306–321.

Sound Production in Pianos, Fundamentals of Musical Acoustics, Arthur H. Benade, Oxford University Press, (New York, London, Toronto) 1976, pp. 328–333.

On the Sensations of Tone, Theory of Music, Hermann L. F. Helmhotz, Dover Publications, Inc. (New York), 1954, various pages.

Hohf, Robert. Performance and Innovation: The Wapin Bridge on CD. Piano Technicians Journal, Jan. 1999, pp. 31–34.

*Primary Examiner*—Jeffrey Donels

*Attorney, Agent, or Firm*—Dinsmore & Shohl LLP

[57] ABSTRACT

An improved string arrangement for coupling one or more of strings to a sound radiating member, such as a soundboard, is provided having a bridge structure with a rib with a bridge face and a bearing point edge. Associated with each string and disposed at least tangent to the bearing point edge and substantially perpendicular to the bridge face is a first bridge pin. A second and/or third bridge pin may also be provided axially behind the first bridge pin for retaining each string against the bridge face. This invention provides enhanced tone quality by improving sustain and amplitude of fundamental frequencies in a convenient and simple structural arrangement for pianos and other stringed devices.

21 Claims, 8 Drawing Sheets

STRING ARRANGEMENT FOR MUSICAL INSTRUMENTS

TECHNICAL FIELD

This invention relates generally to structures for stringed instruments, and more particularly, to an improved string support arrangement and bridge structure which provides increased tonal quality in these instruments.

BACKGROUND OF THE INVENTION

The general assembly of stringed instruments is well known in the art. For example in a piano type arrangement, a plurality of strings are tensioned across a string attachment structure, such as a plate, so that each string may vibrate when struck by a hammer. The strings define the frequency of the note and convert some of the kinetic energy of the moving hammer into vibrational energy with components of vibration in planes parallel and perpendicular to the plate. Piano strings are typically arranged either horizontally (as in a grand piano) or vertically (as in an upright piano) and are generally subdivided into three major groupings: bass, low treble and high treble. Bass commonly refers to the lower-pitched notes, while treble refers to the higher pitched notes. In a piano type arrangement, there are typically three strings for each high treble note, two strings for each low treble note, and one string for each bass note. Each set of one, two, or three strings is often referred to as a unison. There is typically provided one key for each unison or note. A piano generally has 88 keys, and hence 88 notes, spanning at least the frequency range from the note A0 at 27.5 hz to the note C8 at 4186 hz.

In a piano type arrangement, the strings engage a bridge structure for transferring their vibrational energy to a sound amplifying structure, or soundboard. Typically, the bridge structure is disposed transverse to the strings and comprises two angled bridge pins for each string (although some musical instruments, such as a harpsichord, typically are provided with only one bridge pin), with both pins being attached to a curved rib having a top face. Each string has a bearing point, sometimes referred to as a speaking, or vibrating length terminus, located at the bridge structure. Both pins were typically specified to be installed at an angle so that the strings are down-bearing against the bridge and side-bearing against the pins. Such angled bridge pins were believed to be necessary to avoid undesirable performance characteristics, such as strings moving off their designated bearing point at the bridge structure when excited. In fact, inadvertent installation of pins having insufficient angle was to be avoided, as it could similarly cause such performance problems.

The down and side bearing relationship of the strings with the bridge structure also aids in transmitting their vibrational energy to the bridge structure and, in part, defines the mechanical coupling therebetween. Because the strings are the principal reservoir for storing vibrational energy, it is known in the art that the magnitude and manner of the excitation and the boundary conditions of the string are important for determining the tone of a string, although the reasons and interaction are often not fully understood. For example in a piano, the string is typically excited by the impact of a hammer having an impact velocity, the velocity being dependent upon the force input of the pianist at the piano key. It is contemplated that the impact velocity, the physical hardness and density characteristics of the hammer (and its felt covering), and the method of coupling the string to the bridge structure defines, in part, the initial tone of the string.

The tone of a string is often defined by the harmonic content and decay time of the string. When a string is excited (such as by striking with a hammer), it will vibrate at a fundamental frequency which is determined by the vibrating or speaking length of the string, the tension of the string, and the mass per unit length of the string. The string will also vibrate at integer multiples of the fundamental frequency, often referred to as overtones, as well as frequencies producing a "glassy" sound which do not contribute to the perceived pitch of the note. The relative strength, or amplitude, of the fundamental frequency, the overtones, and the frequencies producing the glassy sounds, often together referred to as a spectrum, define the string's harmonic content. The larger the amplitude of the fundamental frequency and the lower overtones (e.g., generally the first 5 to 10 integer multiples of the fundamental frequency depending on whether the string is generally in the high treble, low treble, or bass range), the clearer and more desirable the tone; while alternatively, the more frequencies producing glassy sounds and the greater their amplitudes, the less desirable the tone.

In addition to the harmonic content of a string, the decay rate of the additive amplitude of the string's excited frequencies (e.g., the fundamental frequency, the overtones, and other associated frequencies) is also important in determining a string's tonal quality. In general, the longer the decay time the more desirable the tone. It is even more desirable that the decay time be fairly uniform from note to note so that the multiple notes blend in pleasing harmony with each other when played together. For example, in typical piano type arrangements it is sometimes difficult to achieve a good balance that enables the 5th octave and above of the keyboard (notes C5 through F6, often referred to as the melody range) to sustain long enough (i.e., having a long enough decay time) against the inherently longer decay time of the lower octave ranges (notes C1 through C5).

While previously available bridge structures may function well for the purposes for which they were designed, it has often been desirable, and continues to be desired, to provide improved bridge structures with additional operational advantages. For example, it would be desirable to provide a string arrangement which increases a string's decay time so that juxtaposed notes from different ranges in the piano sound well together. It would also be advantageous to provide an improved string arrangement and bridge structure which reduces the glassy sounds associated with a note and which also produces a clearer note. The present invention provides such an improved string arrangement which can accommodate designs having the abovedescribed tonal benefits and features.

SUMMARY OF THE INVENTION

A string arrangement for musical instruments comprising at least one string and a bridge structure for coupling the string to a sound radiating member is provided. The bridge structure is provided with a bridge face and a bearing point edge. A first bridge pin is located at least tangent to the bearing point edge and substantially perpendicular to the bridge face such that the string simultaneously contacts the bearing point edge and the first bridge pin at the bridge structure.

The bridge structure can also be provided in some preferred embodiments with second and third bridge pins located a second pin axial distance behind the first bridge pin and a third pin axial distance behind the second bridge pin, respectively. Preferably, the second and third pin distances are in a range of between about 1 mm and about 1 cm. The second and third bridges pins may also be oriented, respectively, at a second pin offset angle relative to the first bridge pin, and a third pin offset angle relative to the second bridge pin. In a preferred arrangement, the second and third bridge pin angles are in a range of between about −45 degrees and about 45 degrees relative to the first and second bridge pins.

BRIEF DESCRIPTION OF THE DRAWINGS

While the specification concludes with claims particularly pointing out and distinctly claiming the invention, it is believed the same will be better understood from the following description taken in conjunction with the accompanying drawings in which:

DETAILED DESCRIPTION OF THE PREFERRED EMBODIMENTS

Figure 1:
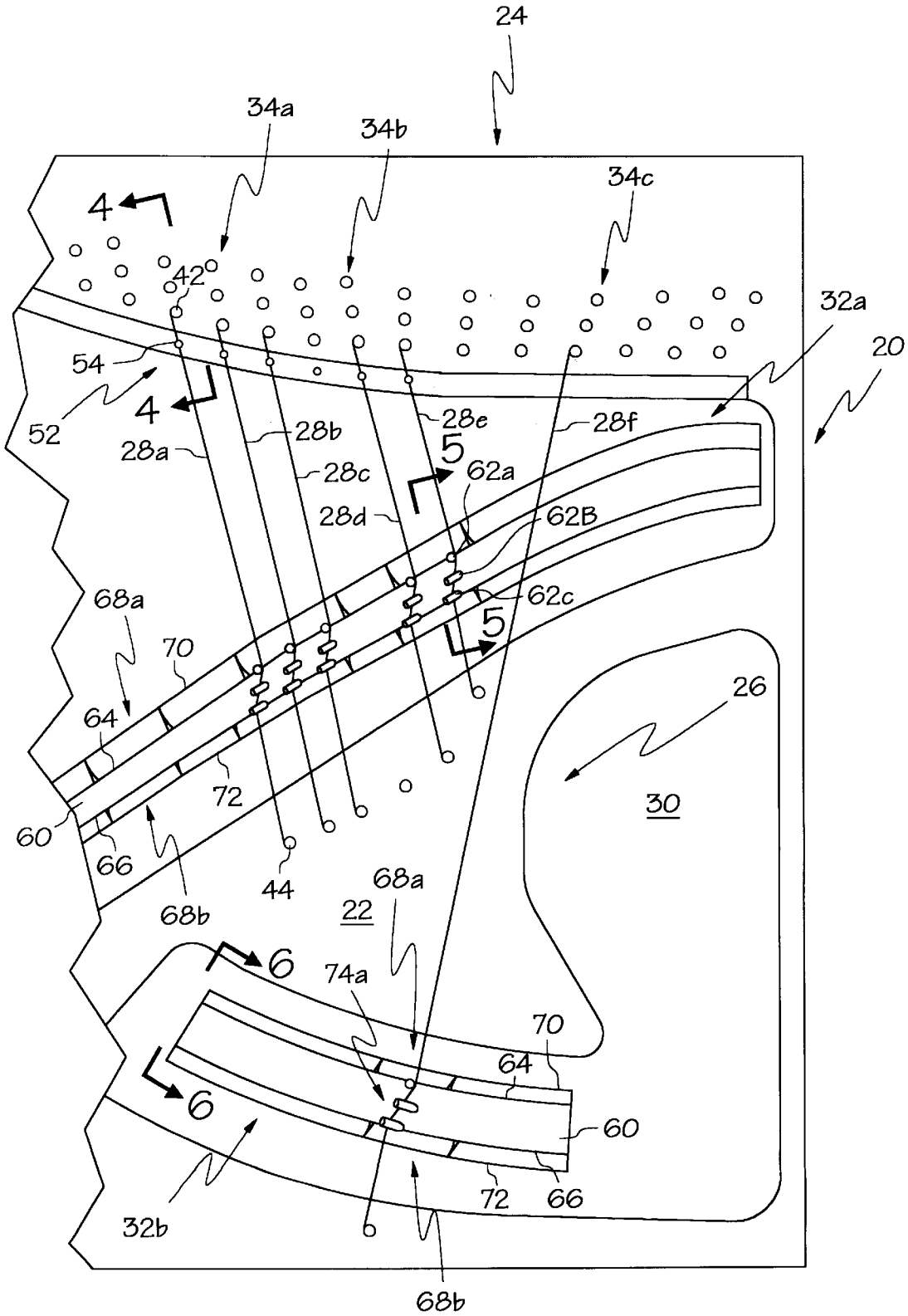
FIG. 1 is a partial plan view of the interior of a piano arrangement made in accordance with the present invention.

Reference will now be made in detail to the presently preferred embodiments of the invention, examples of which are illustrated in the accompanying drawings wherein like numerals indicate the same elements throughout the views. FIG. 1 is a top plan view of a portion of the interior of an exemplary piano 20 (e.g., a grand piano) made in accordance with the present invention, wherein the general features of which will be familiar to those skilled in the art. Although the preferred embodiments of the present invention described herein are particularly suited for use in grand piano arrangements, it is contemplated that the present invention may be implemented in any of variety of other stringed instruments such as upright pianos, harpsichords, clavichords, guitars, mandolins, violins, or the like.

Piano arrangement 20 preferably comprises a string plate 22 having proximal end 24 and distal end 26, a plurality of strings (e.g., 28*a*, 28*b*, 28*c*, 28*d*, 28*e*, 28*f*) tensioned across string plate 22, a soundboard 30 adjacent the strings, and a bridge structure (e.g., 32*a* for treble strings and 32*b* for bass strings) for coupling the strings to soundboard 30. As best illustrated in FIG. 1, an exemplary high treble note is illustrated as preferably comprising strings 28*a*, 28*b*, and 28*c* forming a first unison 34*a*, while an exemplary low treble note comprises strings 28*d* and 28*e* forming a second unison 36*b*. An exemplary bass note is shown as preferably comprising a single string 28*f* forming a third unison 34*c*. The remaining strings of grand piano 20 have been deleted for purposes of clarity.

Figure 2:
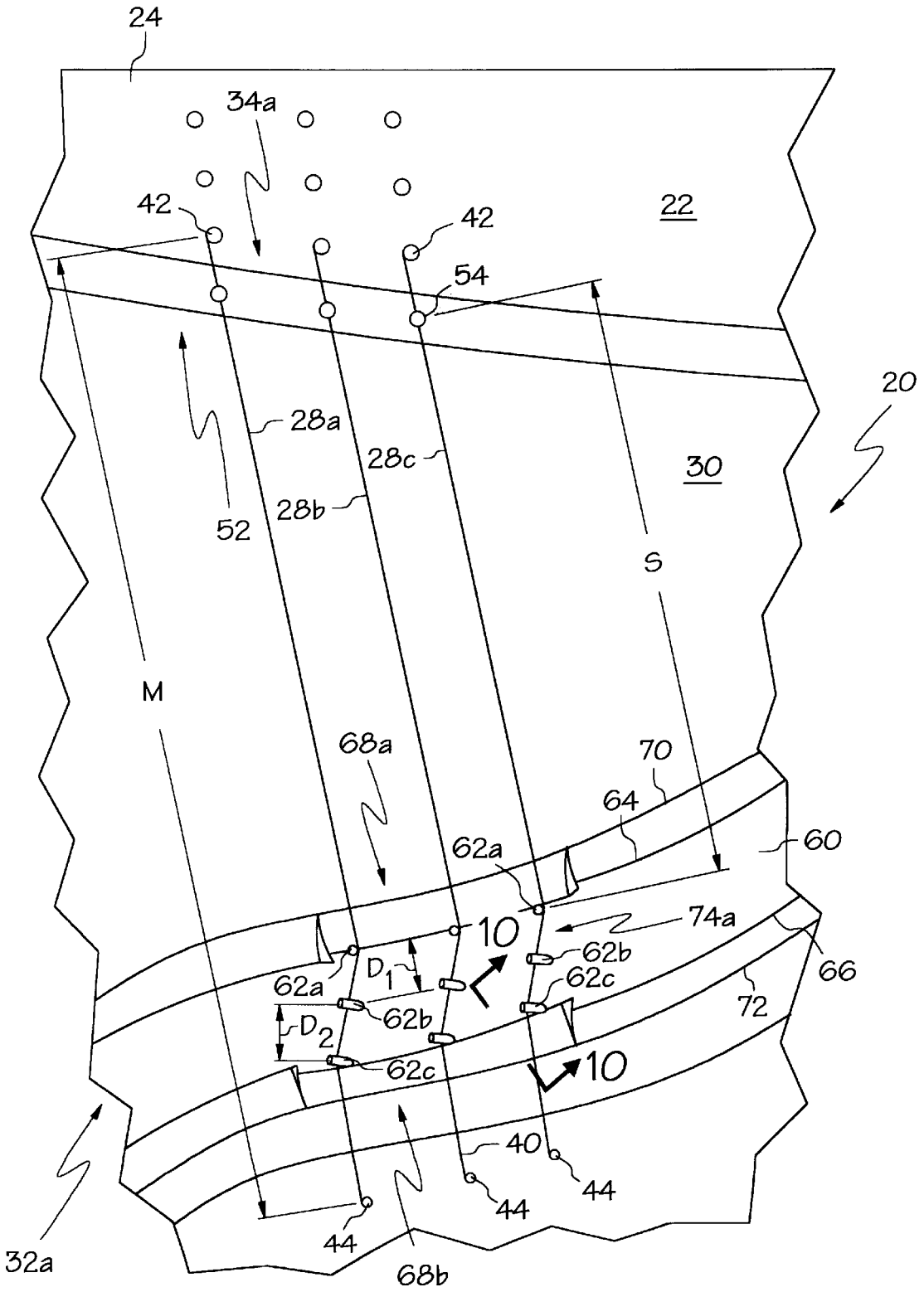
FIG. 2 is an enlarged partial plan view of a portion of the interior of the piano arrangement of FIG. 1.
Figure 3:
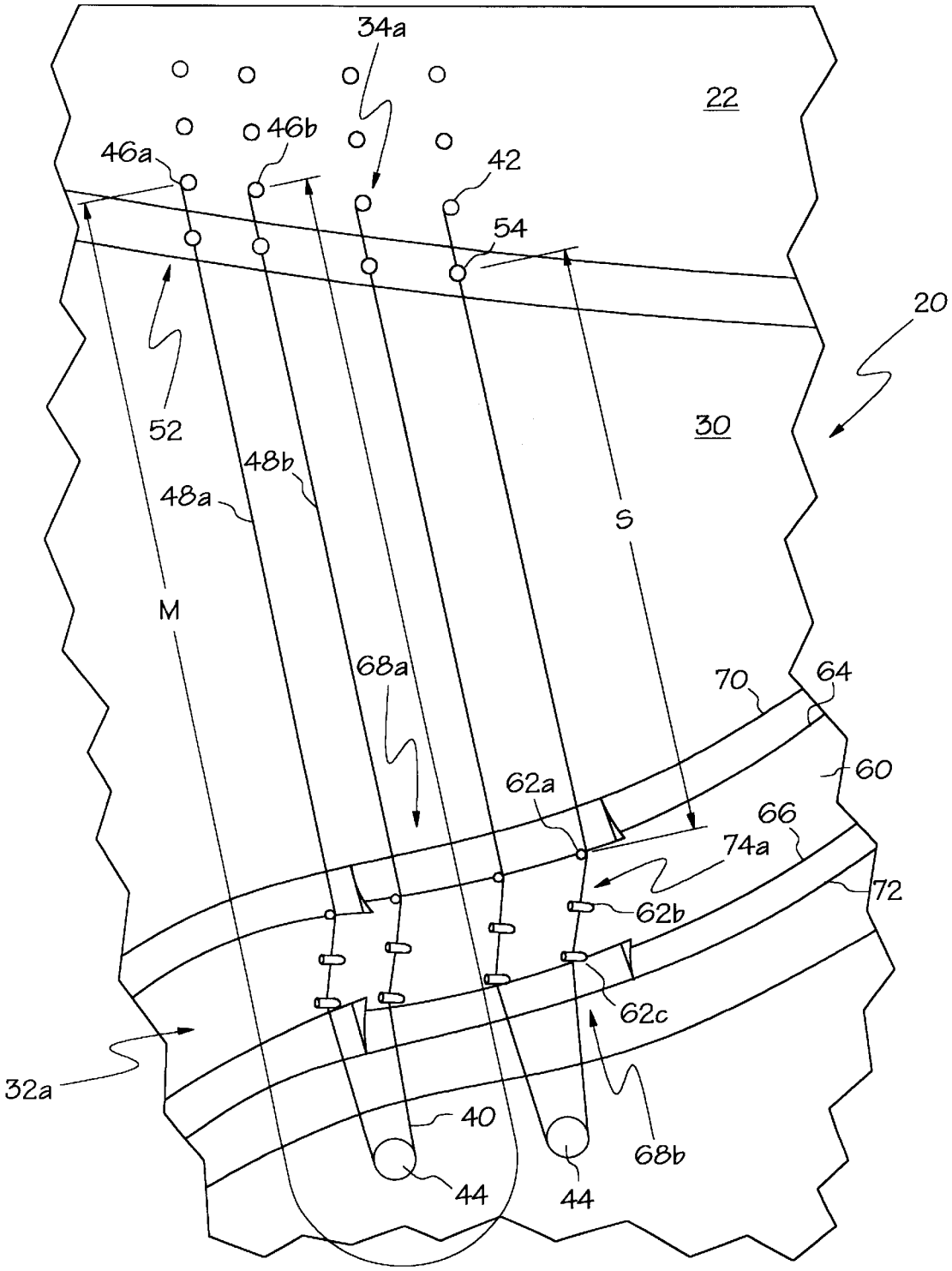
FIG. 3 is an enlarged partial plan view of a portion of the interior of the grand piano of FIG. 1, illustrating an embodiment wherein a single wire comprises two strings on a treble bridge.

Each string (e.g., 28*a*, 28*b*, 28*c*, 28*d*, 28*e*, 28*f*) extends generally diagonally across string plate 22 and is formed from a wire 40 having a mechanical length (e.g., M), as best exemplified in FIG. 2. The string is preferably mechanically terminated at proximal end 24 by tuning pin 42 and at distal end 26 by hitch pin 44 and may be attached to tuning pin 42 and hitch pin 44 such as is known in the art. Although each string may be formed from a distinct wire 40 having a mechanical length M, in a more preferred arrangement, adjacent strings can be formed from the same wire such that mechanical length M defines both strings (FIG. 3). In this arrangement which is generally referred to as "loop stringing," wire 40 is terminated at one end by first tuning pin 46*a* and passes over a bridge structure (e.g., 32*a* or 32*b* as shown in FIG. 1) thereby forming first string 48*a*. The same wire 40 then passes around hitch pin 44 and over the bridge structures again where it is terminated by second tuning pin 46*b*, thereby forming a second adjacent string 48*b*. Thus, adjacent tuning pins 46*a* and 46*b*, rather than a tuning pin and hitch pin, can define the mechanical termination points of wire 40. First string 48*a* and adjacent string 48*b* retain their own distinctive pitch because of the wire's tension and stiffness where it bends around hitch pin 44. Each string is preferably made of high strength steel and may be plain or wrapped in one or more layers of covering wire or other material, with each layer encircling the core in the form of a multi-turn helix.

Figure 4:
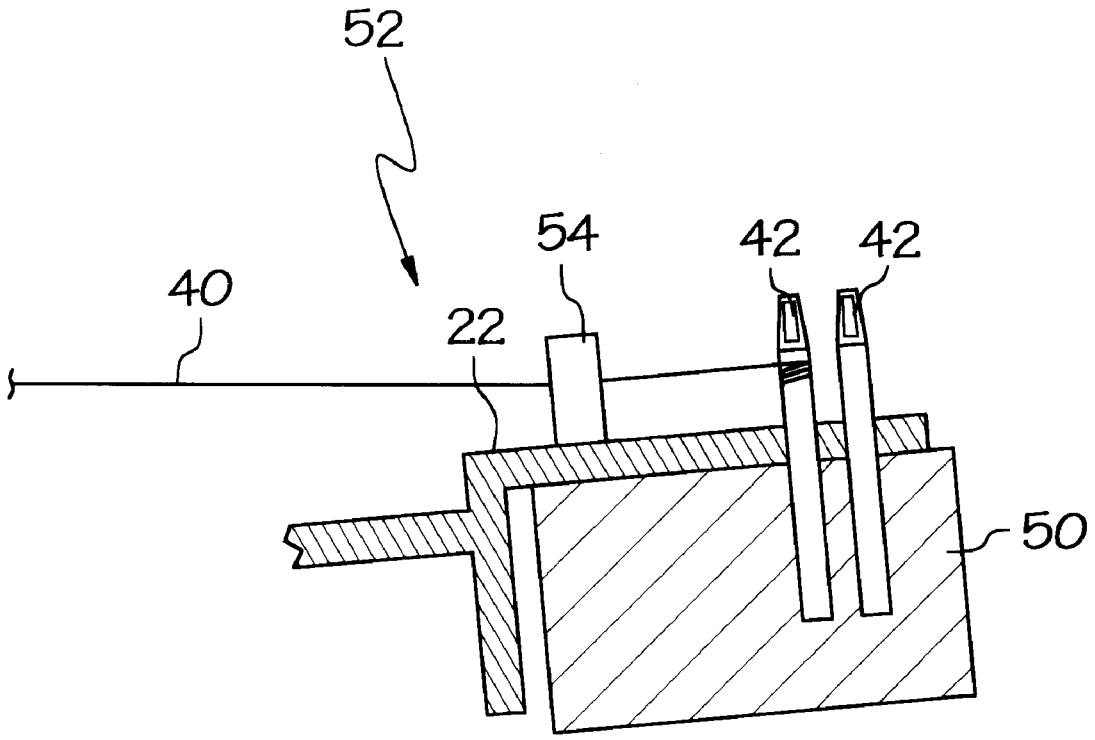
FIG. 4 is a partial cross-sectional view of a portion of the soundboard of the piano arrangement of FIG. 1, taken along line 4—4 thereof.
Figure 5:
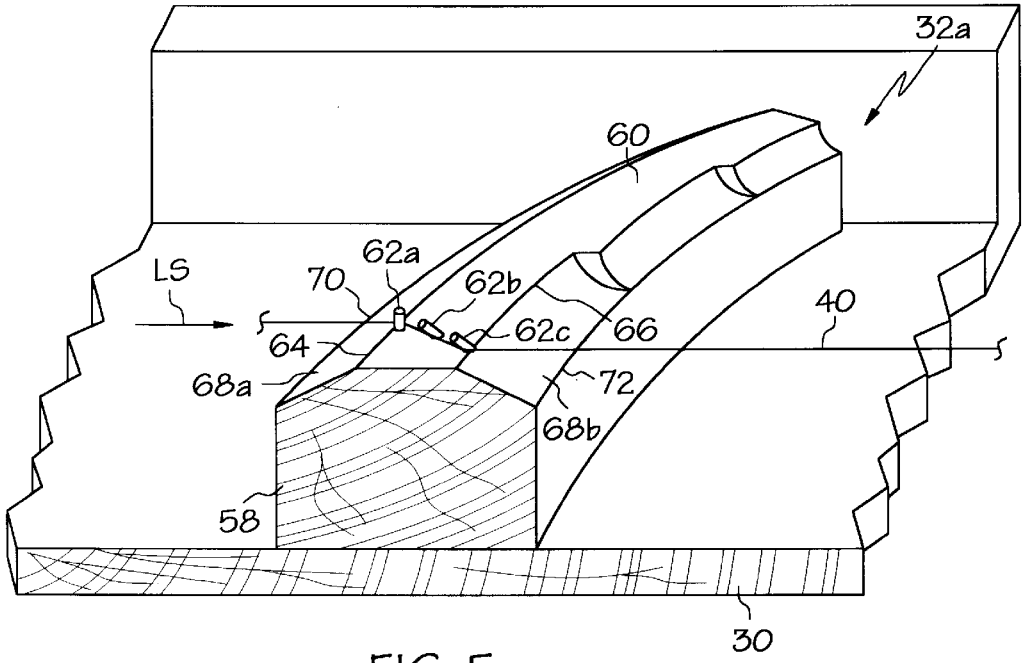
FIG. 5 is a partial perspective view taken at a cross-section of a treble bridge structure of the piano arrangement of FIG. 1 along line 5—5 thereof.

As best seen in FIG. 4, tuning pins 42 preferably pass through string plate 22 into pin block 50 attached to string plate 22. One end of wire 40 is coiled around and attached to a tuning pin 42 so that the wire's tension may be selectively increased or decreased by turning tuning pin 42 which, in turn, adjusts or "tunes" the fundamental frequency of the string formed by wire 40. In this manner, strings forming a unison (e.g., 34*a*, 34*b*, and 34*c*) may be properly maintained in harmony with one another.

Preferably, each bridge structure is attached (such as by gluing) to soundboard 30, so that the combined structure functions to mechanically oppose the downward bearing load created by the tensioned strings and also acts as an acoustic radiating member of the stringed arrangement (e.g., piano 20) by transforming some of the mechanical energy of the strings and bridges into acoustic energy. Soundboard 30 and bridge structures 32*a* and 32*b* are preferably made of tone wood, either solid or laminate. The soundboard is typically manufactured from a softwood such as spruce while the bridge is formed from hardwoods such as maple or beech.

As seen best in FIG. 2, the vibrational length, or speaking length, S of each string has a first and second terminus. The first terminus is provided by deflection element 52 at proximal end 24 whereby a sufficient deflection, or effective deflection, of the string is created. In a preferred arrangement, deflection element 52 can be agraffe pin 54 which is secured to string plate 22 or a V-bar (not illustrated), as is commonly known in the art.

The second terminus can be provided by a bridge structure (e.g., 32*a*, 32*b*) at distal end 26, as best seen in FIGS.

Figure 6:
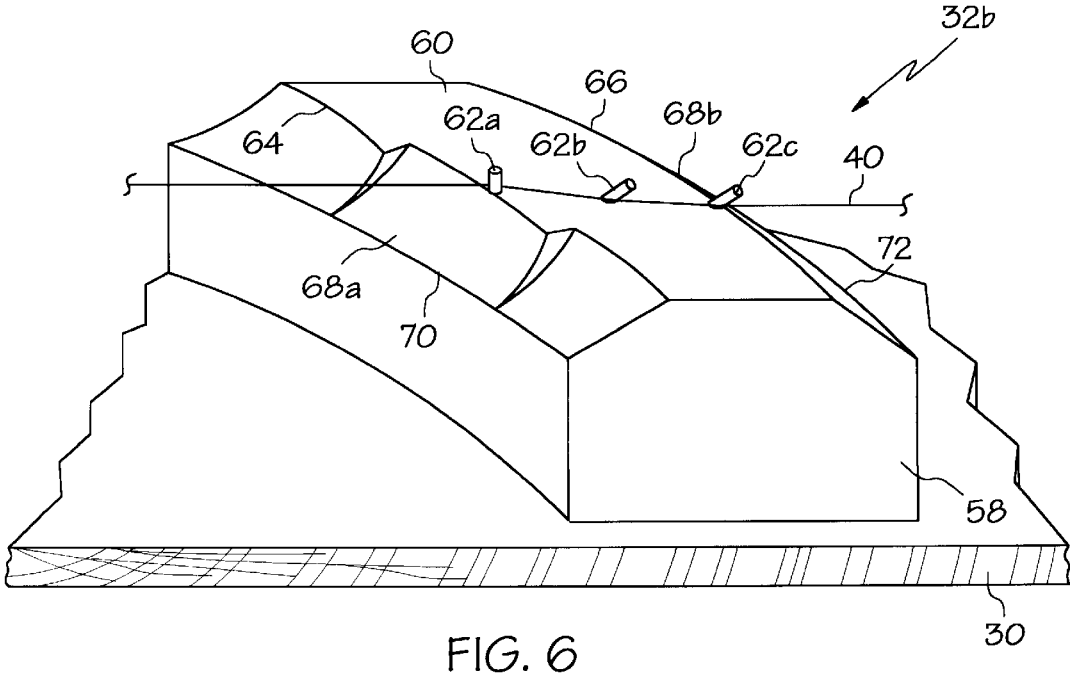
FIG. 6 is a partial cross-sectional view of a bass bridge structure of the piano arrangement of FIG. 1, taken along line 6—6 thereof.
Figure 7:
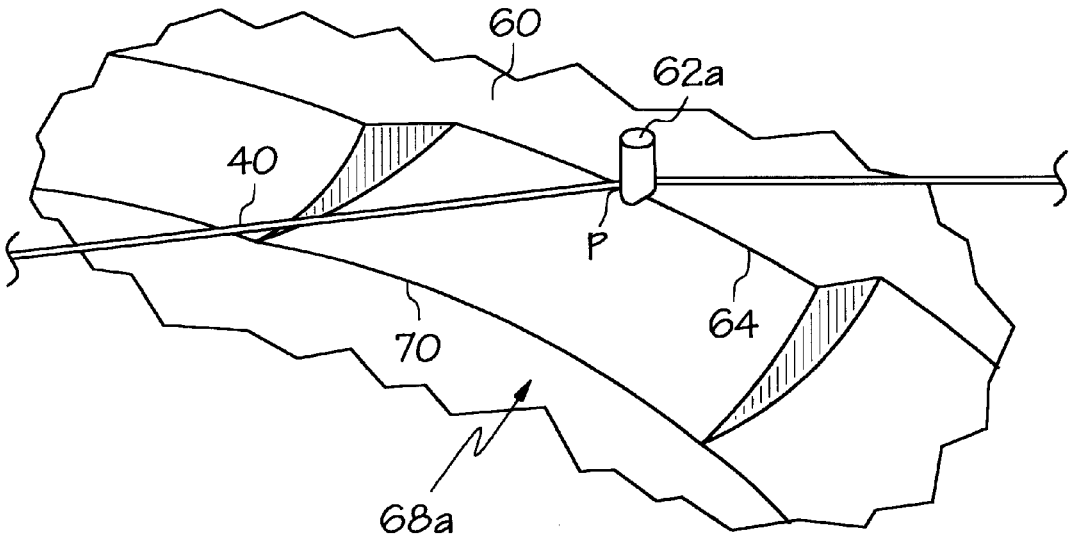
FIG. 7 is an enlarged front perspective view of the treble bridge structure of FIG. 5, looking along line of sight LS thereof.
Figure 8:
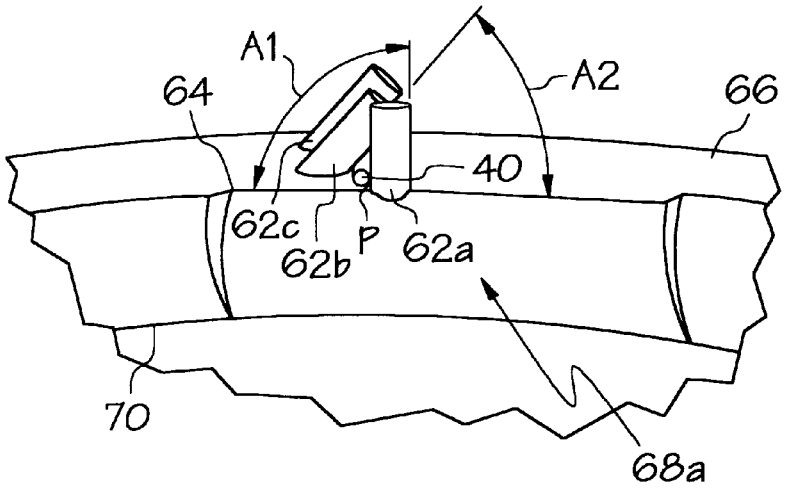
FIG. 8 is an enlarged left side view of the treble bridge structure of FIG. 5.

5 (bridge structure 32*a*), and 6 (bridge structure 32*b*). Each bridge structure preferably comprises a bridge rib 58 having a bridge face 60 and a first bridge pin 62*a*, a second bridge pin 62*b*, and a third bridge pin 62*c* associated with each string. Bridge face 60 is further illustrated with a bearing point edge 64 and back edge 66. As is commonly known in the art, bearing point edge 64 and first bridge pin 62*a* preferably cooperate in defining the second terminus of a string's speaking length S. First bridge pin 62*a* is preferably located on the bridge structure (e.g., 32*a* or 32*b*) such that at least a portion of first bridge pin 62*a* at least tangentially intersects bearing point edge 64. More preferably, first bridge pin 62*a* is located on the bridge structure such that bearing point edge 64 approximately bisects each first bridge pin 62*a*, as illustrated in FIG. 6, so that each string (e.g., 28*a*, 28*b*, 28*c*, 28*d*, 28*e*, and 28*f*) contacts bearing point edge 64 and first bridge pin in the same plane generally perpendicular to the longitudinal axis of the string 62*a* (e.g., P), as best illustrated in FIGS. 7 and 8. By insuring that the first bridge pin contacts or is at least tangent to the bearing edge, each string has only one effective second terminus of its speaking length S at the bridge structure. To insure adequate clearance between each string and the bridge structure such that a string's first bridge structure contact is at bearing point edge 64, a first notch 68*a*, or cut-away, may be associated with each unison (e.g., 34*a*, 34*b*, 34*c*) and disposed between leading edge 70 and bearing point edge 64. A second notch 68b located between trailing edge 72 and back edge 66 can also be provided so that adequate clearance may also be provided thereat, although this notch is not required.

First bridge pin 62*a* is preferably oriented in a manner substantially perpendicular to bridge face 60 at its attachment therewith. The term substantially perpendicular, as used herein, is intended to mean that first bridge pin 62*a* has an angle $A_1$ (FIG. 8) relative to bridge face 60 of about 90 degrees ±about 5 degrees. More preferably, angle $A_1$ is about 90 degrees ±about 2 degrees, and most preferably is nominally about 90 degrees. It is believed that placement of a first bridge pin 62*a* in an orientation substantially perpendicular to bridge face 60 provides a tone which has a longer decay time and is "brighter" than tones of strings having a first bridge pin 62*a* which is not substantially perpendicular. Although the nature of the mechanical coupling between the strings, bridge structures 62*a* and 62*b* and soundboard 30 and its influence on tone quality is not fully understood, and not intending to be bound by any particular theory herein, it is believed that the perceptible sustain time of an excited string in an arrangement incorporating the present invention is effectively and perceptively longer than a comparable string whose speaking length S is terminated by a bridge structure having a first bridge pin which is not substantially perpendicular, as defined herein. It is further believed that the fundamental frequency of an excited string in an arrangement incorporating the present invention may have a greater amplitude than its first overtone when compared to a comparable string which is not substantially perpendicular.

It is further contemplated that the above-described benefits of a substantially perpendicular first bridge pin are derived from an increase in the amount of a string's initial vibrational energy in a plane generally parallel to the soundboard (i.e., generally perpendicular to a first bridge pin incorporating the present invention). Because the mechanical impedance in the plane parallel to the soundboard is high relative to the mechanical impedance in the plane perpendicular to the soundboard, a string's vibrational energy is dissipated largely in the perpendicular plane. As such, it is contemplated that the present arrangement places more energy into a plane which is parallel to the soundboard and produces a tone with a longer decay time because more energy is initially "stored" for later dissipation in the perpendicular plane.

Figure 9A:
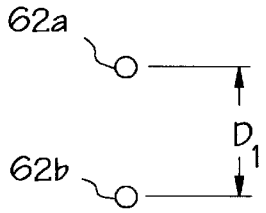
FIGS. 9A–9H are schematic views of bridge pin arrangements of the present invention.

The bridge structure can also be provided with a second bridge pin 62*b* and/or third bridge pin 62*c* for mechanically anchoring a string such that it does not move off of bearing point edge 64 when excited. Second bridge pin 62*b* can be preferably disposed at a second pin axial distance $D_1$ behind and substantially in line with first bridge pin 62*a*, as best shown in FIG. 9A where bridge structure details have been removed for clarity (FIGS. 9 A–H are intended only to illustrate possible placements of bridge pins 62*a*, 62*b*, and 62*c* relative to each another, and are intended neither to be exhaustive of such arrangements nor to illustrate preferred bridge pin locations). In a more preferred arrangement, distance $D_1$ is in a range of between about 1 mm and about 1 cm.

Figure 9B:
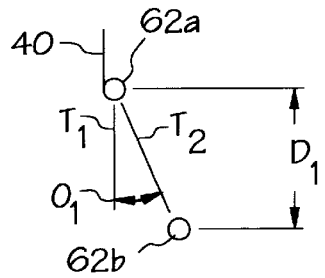
Figure 9C:
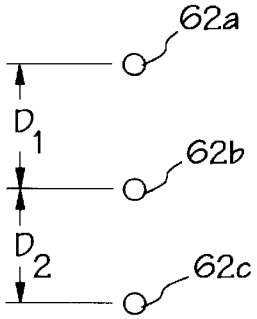
Figure 9D:
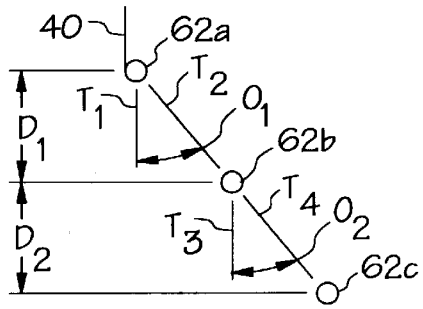
Figure 9E:
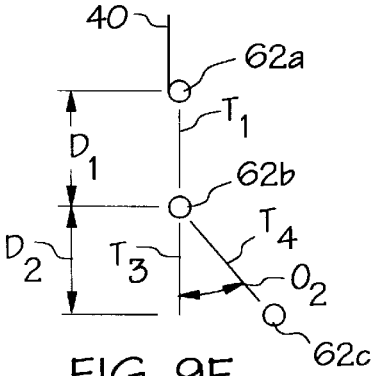
Figure 9F:
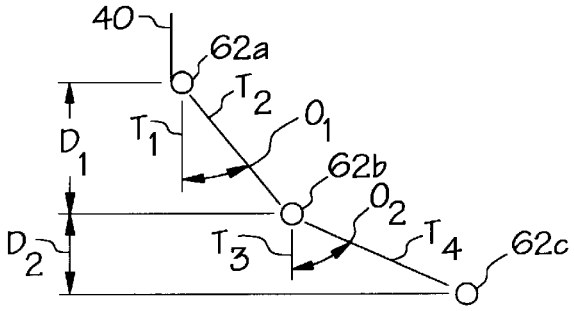
Figure 9G:
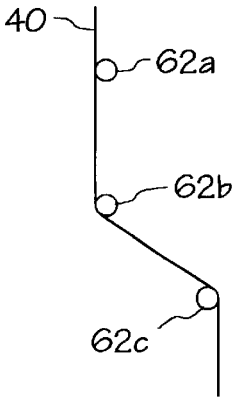
Figure 9H:
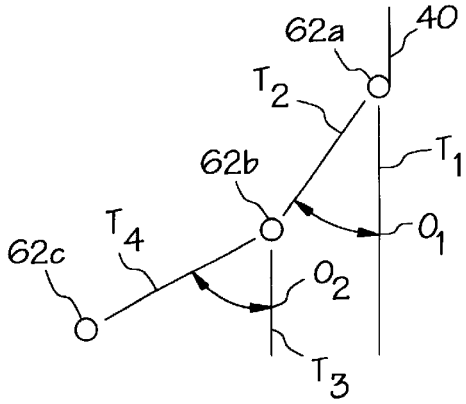

Second bridge pin 62*b* may also be provided with a second pin offset angle (e.g., $O_1$) relative to first bridge pin 62*a*, as best illustrated in FIGS. 9B, 9D, 9F and 9H. Offset angle $O_1$, as used herein, is intended to show the angle between theoretical line $T_1$ parallel to wire 40 but passing through the center point of first bridge pin 62*a*, and theoretical line $T_2$ which passes through the center points of first bridge pin 62*a* and second bridge pin 62*b*, as best shown in FIG. 9B. Preferably, offset angle $O_1$ is in a range of between about −45 degrees and about 45 degrees (FIGS. 9B through 9F depict a positive offset angle $O_1$ while FIG. 9H depicts a negative offset angle $O_1$).

Second bridge pin 62*b* can also be provided with a second pin orientation angle $A_2$ from bridge face 60, as best illustrated in FIG. 8, so that each string is maintained in a down-bearing condition against bridge face 60, and side-bearing against first and second bridge pins 62*a* and 62*b*. In a preferred arrangement, second pin orientation angle $A_2$ is in a range of between about 65 degrees and about 80 degrees or in range of between about 100 degrees and about 115°. It is believed that the side and down-bearing relationship of each string may prevent movement of the string off of bearing point edge 64 which, in turn, can prevent the second terminus of speaking length S from shifting when a string is excited. In addition, maintaining the down and sidebearing condition of each string against bridge face 60 and first and second bridge pins 62*a* and 62*b*, respectively, can aid in the transmission of each string's vibrational energy to the bridge structure and soundboard 30. Although it is preferable that second bridge pin 62*b* be oriented at an angle $A_2$, it is contemplated that it can also be substantially perpendicular to bridge face 60, and may further be provided with a notch, groove, or the like (not illustrated) for restricting movement of a string (e.g., 28*a*, 28*b*, 28*c*, 28*d*, 28*e*, 28*f*) in a direction generally perpendicular to bridge face 60.

Figure 10:
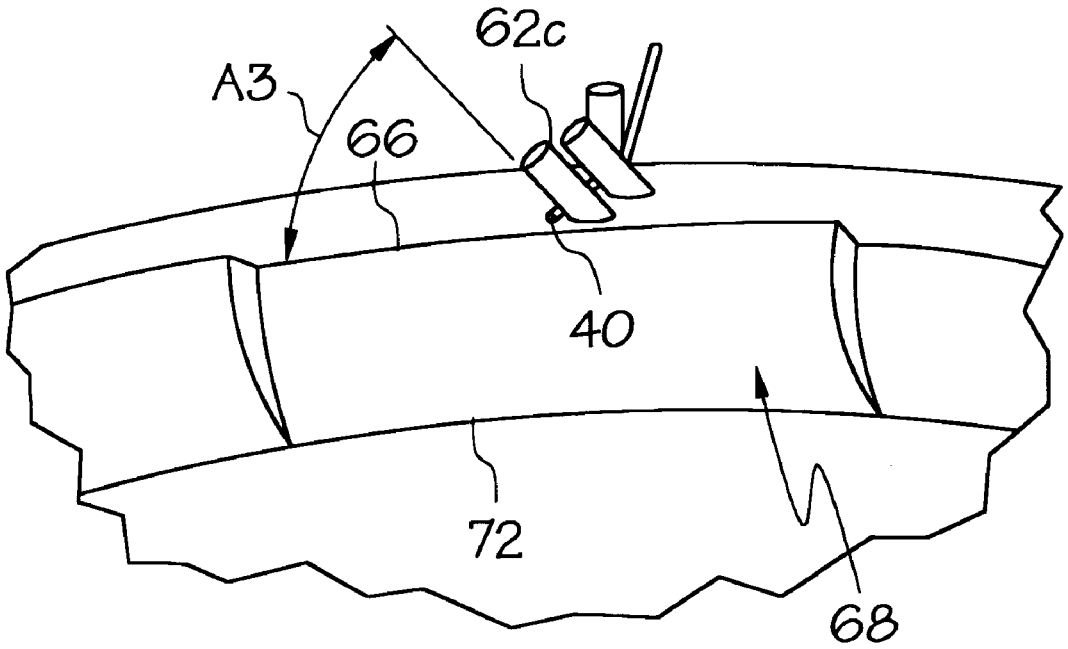
FIG. 10 is an enlarged right side view of the treble bridge structure of FIG. 5.

Third bridge pin 62*c* can preferably be located at a third pin axial distance $D_2$ behind and substantially in line with second bridge pin 62*b*, as best seen in FIG. 9C. Although it is believed that the exact location of third bridge pin 62*c* is not critical, in a more preferred arrangement, third bridge pin 62*c* is placed at a distance $D_2$ in a range of between about 1 mm and about 1 cm at pin 62*b*. Third bridge pin 62*c* can be oriented substantially perpendicularly to bridge face 60, or may be preferably provided at a third pin orientation angle $A_3$ (FIG. 10) with respect to bridge face 60 with such angle being in a range of between about 65 degrees and about 80 degrees if it is located on the same side of the string as second bridge pin 62*b* (FIG. 2). Alternatively, third bridge pin 62*c* may preferably be provided with a third pin orientation angle $A_3$ in a range of between about 100 degrees and about 115 degrees if it is located on the opposite side of the string as second bridge pin 62*b* (e.g., FIG. 9G).

In a more preferred arrangement, third bridge pin 62*c* may be provided with a third pin offset angle $O_2$ from second bridge pin 62*c*. Offset angle O, as used herein, is to connote the angle between theoretical line $T_3$, which is parallel to or colinear with theoretical line $T_1$, and theoretical line $T_4$ which passes through the center points of second bridge pin 62*b* and third bridge pin 62*c*, as best seen in FIG. 9E. Preferably, offset angle $O_2$ is in a range of between about −45 degrees and about 45 degrees (FIGS. 9D, 9E and 9F depict a positive offset angle $O_2$ while FIG. 9H depicts a negative offset angle $O_2$).

Although it is preferred that bridge structure 32*a* or 32*b* be provided with three bridge pins per string, it is contemplated that the bridge structures may be provided with various other pin arrangements, such as with only two bridge pins (i.e., a first substantially perpendicular bridge pin 62*a* and second bridge pin 62*b*), without deviating from the scope of this invention. Similarly, it is also contemplated that the bridge structures may be provided with only a single substantially perpendicular first bridge pin 62*a* with each string being anchored by a pin, or other anchoring structure, at some axial distance behind the bridge structure (not illustrated). In the alternative, a single bridge pin (not illustrated) may be provided which combines the functions and structure of first bridge pin 62*a* with second bridge pin 62*b* (not illustrated). Such a single bridge pin, for example, could be provided with both a substantially perpendicular face and an angled face as otherwise provided herein by separate bridge pins.

The bridge pins may be manufactured from hardened steel, or the like, and may hollow, or more preferably solid, and coated with copper, chrome or zinc for wear resistance. Although it is believed that the diameter of the bridge pins may vary without detracting from the scope of this invention for use in piano arrangements, it is preferred that the each pin have a diameter in range of between about 0.15 cm and about 0.25 cm. In addition, although it is preferred that each bridge pin have a substantially cylindrical shape, it is contemplated that other conformations (e.g., elliptical or otherwise rounded, square, triangular) and configurations (e.g., a single pin combining the function and/or structure of first bridge pin 62*a*, second bridge pin 62*b*, and/or third bridge pin 62*c*) may be equally suitable.

The foregoing description of the preferred embodiments have been presented for purposes of illustration and description, and is not intended to be exhaustive or to limit the invention to the precise forms disclosed. Modifications or variations are possible and contemplated in light of the above teachings by those skilled in the art, and the embodiments discussed were chosen and described in order to best illustrate the principles of the invention and its practical application, and indeed to thereby enable utilization of the invention in various embodiments and with various modifications as suited to the particular instrument and use contemplated. It is intended that the scope of the invention be defined by the claims appended hereto.

We claim:

1. A string arrangement for musical instruments having at least one string coupled to a sound radiating member, said arrangement comprising:

a bridge structure having a bridge face and a bearing point edge;

a first pin located adjacent to said bearing point edge and substantially perpendicular to said bridge face;

a second pin located at a second pin distance behind said first pin; and a string contacting said first and second pins, said second pin maintaining said string in down-bearing contacting relation with said bearing point edge.

2. The string arrangement of claim 1, wherein said second pin is located axially behind said first pin.

3. The string arrangement of claim 1, wherein said second pin is oriented at a second pin offset angle relative to said first bridge pin.

4. The string arrangement of claim 1, further comprising a third bridge pin located at a third pin axial distance behind said second pin.

5. The string arrangement of claim 4, wherein said third pin has a third pin offset angle from said second bridge pin.

6. The string arrangement of claim 1, further comprising a plurality of strings.

7. The string arrangement of claim 1, wherein said second pin is disposed on said bridge structure.

8. A string arrangement for musical instruments comprising:

a string plate;

a plurality of strings tensioned across said plate;

a soundboard located adjacent said string plate;

a bridge structure attached to said soundboard for coupling said strings to said soundboard, said bridge structure having a bridge face and a bearing point edge;

a first bridge pin associated with each of said strings and located at least tangent to said bearing point edge and substantially perpendicular to said bridge face, each of said strings contacting said bearing point edge and its associated first pin; and a second bridge pin associated with each of said first bridge pins and located at a second pin distance behind said first bridge, said second bridge pin maintaining its associated string in down-bearing contacting relation with said bearing point edge.

9. The string arrangement of claim 8, wherein said second pin distance is in a range of from 1 mm to 1 cm from said first pin.

10. The string arrangement of claim 8, wherein said second pin is oriented at a second pin offset angle relative to said first bridge pin.

11. The string arrangement of claim 10, wherein said second pin offset angle is in a range of from −45 degrees to 45 degrees.

12. The string arrangement of claim 8, wherein said second pin is oriented at a second pin orientation angle.

13. The string arrangement of claim 12, wherein said second pin orientation angle is in a range of from 65 degrees to 80 degrees from said bridge face.

14. The string arrangement of claim 8 further comprising a third bridge pin located a third bridge pin distance axially behind said second pin.

15. The instrument of claim 14, wherein said third pin distance is in a range of from 1 mm to 1 cm from said second pin.

16. The instrument of claim 14, wherein said third pin is oriented at a third pin orientation angle.

17. The instrument of claim 14, wherein said third pin is oriented at a third pin offset angle relative to said second pin.

18. The instrument of claim 15, wherein said third pin offset angle is in a range of from −45 degrees to 45 degrees.

19. A string arrangement for musical instruments comprising:

a string plate having a proximal end;

a plurality of strings tensioned across said plate, each said string having a vibrational length;

a deflection element associated with each said string disposed adjacent said proximal end, said deflection element providing a first terminus of said vibrational length of each said string;

a soundboard located adjacent said string plate;

a bridge structure attached to said soundboard for coupling said strings to said soundboard, said bridge structure having a bridge face and a bearing point edge;

a first bridge pin associated with each of said strings and located at least tangent to said bearing point edge and substantially perpendicular to said bridge face, each of said strings contacting said bearing point edges said first pin providing a second terminus of said vibrational length of its associated string; and a second bridge pin associated with each of said first bridge pins and located at a second pin distance behind said first bridge pin, said second bridge pin maintaining its associated string in down-bearing contacting relation with said bearing point edge.

20. The string arrangement of claim 19, wherein said deflection element is an agraffe pin.

21. The string arrangement of claim 19, wherein said second pin is oriented at a second pin offset angle relative to said first pin.

* * * * *

UNITED STATES PATENT AND TRADEMARK OFFICE

CERTIFICATE OF CORRECTION

PATENT NO. : 6,100,457
DATED : August 8, 2000
INVENTOR(S) : Harris et al.

It is certified that error appears in the above-identified patent and that said Letters Patent is hereby corrected as shown below:

Column 4,
Line 5, change "36*b*" to -- 34*b* --.

Column 10,
Line 2, change "edges" to -- edge, --.

Signed and Sealed this

Tenth Day of June, 2003

JAMES E. ROGAN
*Director of the United States Patent and Trademark Office*